US007959319B2

(12) United States Patent
Chien

(10) Patent No.: US 7,959,319 B2
(45) Date of Patent: Jun. 14, 2011

(54) LIGHT EMITTING DIODE LAMP WITH HOLES FOR HEAT DISSIPATION

(75) Inventor: Wen-Hsiang Chien, Taipei (TW)

(73) Assignee: Advanced Connectek Inc., Taipei (TW)

( * ) Notice: Subject to any disclaimer, the term of this patent is extended or adjusted under 35 U.S.C. 154(b) by 230 days.

(21) Appl. No.: 12/336,545

(22) Filed: Dec. 17, 2008

(65) Prior Publication Data

US 2010/0118526 A1 May 13, 2010

(30) Foreign Application Priority Data

Nov. 10, 2008 (TW) ..... 97220147 U

(51) Int. Cl.
*F21V 9/08* (2006.01)
*F21V 5/00* (2006.01)
*F21V 29/00* (2006.01)
*F21S 4/00* (2006.01)

(52) U.S. Cl. ..... 362/230; 362/218; 362/224; 362/246; 362/249.02; 362/294; 362/361

(58) Field of Classification Search ..... 362/218, 362/219, 224, 230, 246, 248, 249.02, 406, 362/294, 345, 373, 351, 361, 404
See application file for complete search history.

(56) References Cited

U.S. PATENT DOCUMENTS 827,783 A * 8/1906 Brown ..... 362/406
2,800,574 A * 7/1957 Belbes et al. ..... 362/224
3,209,142 A * 9/1965 Michel et al. ..... 362/218
3,846,072 A * 11/1974 Patterson ..... 96/222
4,352,148 A * 9/1982 McJunkin et al. ..... 362/224
4,876,633 A * 10/1989 Engel ..... 362/224
5,103,382 A * 4/1992 Kondo et al. ..... 362/249.04
6,132,061 A * 10/2000 Andrus et al. ..... 362/218
6,352,358 B1 * 3/2002 Lieberman et al. ..... 362/294
6,361,186 B1 * 3/2002 Slayden ..... 362/249.02
6,726,348 B2 * 4/2004 Gloisten ..... 362/249.02
7,048,410 B2 * 5/2006 Kutler ..... 362/218
7,611,260 B1 * 11/2009 Lin et al. ..... 362/224
7,635,201 B2 * 12/2009 Deng ..... 362/249.02
7,766,505 B2 * 8/2010 Tseng et al. ..... 362/217.17
2009/0273926 A1 * 11/2009 Deng ..... 362/249.02

FOREIGN PATENT DOCUMENTS

EP 2187120 A2 * 5/2010

* cited by examiner

*Primary Examiner* — Alan Cariaso
(74) *Attorney, Agent, or Firm* — Jianq Chyun IP Office

(57) ABSTRACT

A lamp includes a tube-shaped lamp shade with a space, a first light-emitting diode (LED) light source, a first diffuser, a second LED light source, a second diffuser, and two covers. A spacer extending along the direction of the length of the tube-shaped lamp shade is disposed in the space. The spacer has a first surface and a second surface, and the tube-shaped lamp shade has a first slot and a second slot. The first LED light source is disposed on the first surface. The first diffuser is disposed in the first slot, and a first hole is formed at the first diffuser. The second LED light source is disposed on the second surface. The second diffuser is disposed in the second slot. The two covers are disposed at two ends of the tube-shaped lamp shade respectively, and each cover has a second hole.

13 Claims, 3 Drawing Sheets

LIGHT EMITTING DIODE LAMP WITH HOLES FOR HEAT DISSIPATION

CROSS-REFERENCE TO RELATED APPLICATION

This application claims the priority benefit of Taiwan application serial no. 97220147, filed on Nov. 10, 2008. The entirety of the above-mentioned patent application is hereby incorporated by reference herein and made a part of this specification.

BACKGROUND OF THE INVENTION

1. Field of the Invention

The present invention generally relates to a lamp, in particular, to a lamp which utilizes LEDs as its light source.

2. Description of Related Art

Light-emitting diodes (LEDs) are semiconductor devices. A light-emitting chip of the LED is mainly made of a compound of Group III-V Elements, for example, GaP or GaAs. The light-emitting principle of the LED is to convert electric energy into light energy. In particular, the LED applies a current to the compound semiconductor, and releases the excessive energy in the form of light through a combination of electrons and holes. As the light emission phenomenon of the LED is not achieved by heating or electric discharging, the service life of the LED reaches over one hundred thousand hours. Besides, the LED is also advantageous in having a high response speed, small size, low power consumption, low contamination, and high reliability, and it is further suitable for mass production. Therefore, the LED has been widely applied, including light sources and illuminating lamps for, for example, large-sized display billboards, traffic lights, cell phones, scanners, faxes, and the like.

In recent years, due to the continuous increasing of the luminous intensity and efficiency, the LED has been gradually applied in illuminating lamps. Generally, high-power LEDs all have problems of heat dissipation. If the LED operates under an excessively high temperature, the luminous intensity thereof may be attenuated, and the service life thereof may also be shortened. Therefore, the heat dissipation design of an LED lamp has already become an importation issue focused by researchers in this field.

SUMMARY OF THE INVENTION

Accordingly, the present invention is directed to a light-emitting diode (LED) lamp, which has a desirable heat dissipation performance.

As embodied and broadly described herein, the present invention provides a lamp, which includes a tube-shaped lamp shade with a space, a first LED light source, a first diffuser, a second LED light source, a second diffuser, and two covers. A spacer extending along a direction of a length of the tube-shaped lamp shade is disposed in the space. The spacer has a first surface and a second surface, and the tube-shaped lamp shade has a first slot and a second slot. The first LED light source is disposed on the first surface. The first diffuser is disposed in the first slot, and a first hole is formed at the first diffuser. The second LED light source is disposed on the second surface. The second diffuser is disposed in the second slot. The two covers are disposed at two ends of the tube-shaped lamp shade respectively, and each cover has a second hole.

In an embodiment of the present invention, the first LED light source generates heat in operation, such that an air convection occurs between the space and an external environment. During the air convection, an external air enters the space through the second holes on the two covers and flows out to the exterior from the first hole on the first diffuser.

In an embodiment of the present invention, the second LED light source emits a white light to the second diffuser, so that the second diffuser outputs a white illumination light.

In an embodiment of the present invention, the first LED light source emits a white light to the first diffuser, and the first diffuser, as a color filter, outputs a color circumstantial light.

In an embodiment of the present invention, the first LED light source emits a color light to the first diffuser, and the first diffuser, as a transparent filter, outputs a color circumstantial light.

In an embodiment of the present invention, a stopping portion is disposed and protruded from an inner edge of the first slot of the tube-shaped lamp shade, and supports a bottom of the first diffuser.

In an embodiment of the present invention, the second slot of the tube-shaped lamp shade extends to the two ends of the tube-shaped lamp shade, a slide-rail is formed on an inner edge of the second slot, and the second diffuser is movably disposed on the slide-rail.

In an embodiment of the present invention, the lamp further includes a base and a connecting rod. The connecting rod is connected between the base and the tube-shaped lamp shade.

In an embodiment of the present invention, the lamp further includes a weight block disposed on the first surface of the spacer. The connecting rod penetrates the tube-shaped lamp shade and is fixed to the weight block.

In an embodiment of the present invention, a sliding groove is formed on the first surface of the spacer, and the weight block is disposed in the sliding groove.

In an embodiment of the present invention, the lamp further includes a plurality of screws, penetrating the spacer and the weight block, so as to lock the weight block to the spacer.

In an embodiment of the present invention, the base is a hollow shell with an opening formed thereon, the connecting rod penetrates the opening, and a stopping block is disposed at an end of the connecting rod in the hollow shell, so as to rest against a peripheral edge of the opening.

In an embodiment of the present invention, the lamp further includes two patterned elements respectively disposed on the two covers.

In view of the above, the lamp of the present invention has a plurality of holes for the air to flow in and out, and thus the air convection efficiency of the lamp in operation is improved. Therefore, the lamp of the present invention achieves a better heat dissipation performance.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention.

DESCRIPTION OF THE EMBODIMENTS

Figure 1:
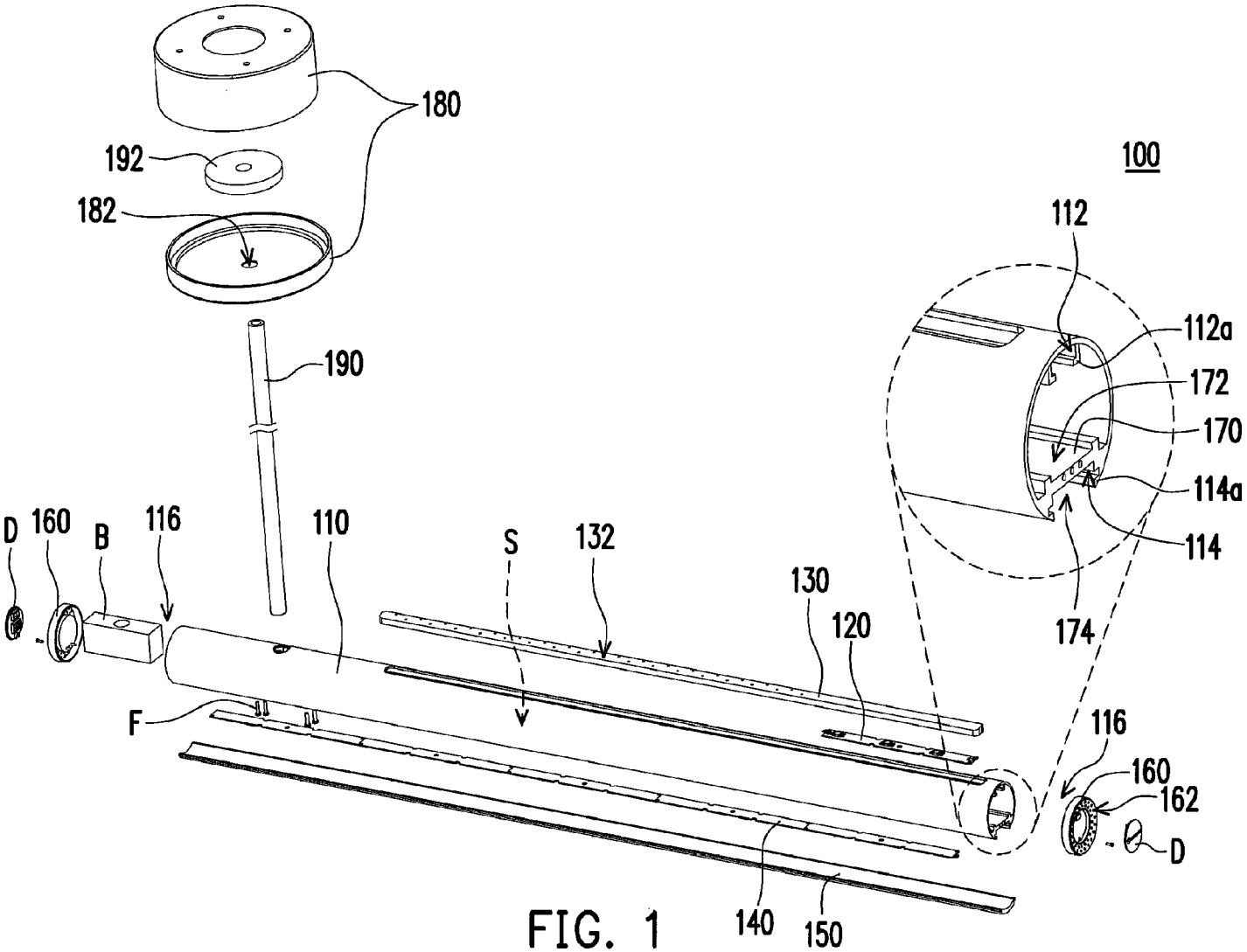
FIG. 1 is a perspective exploded view of a lamp according to an embodiment of the present invention.

Reference will now be made in detail to the present embodiments of the invention, examples of which are illustrated in the accompanying drawings. Wherever possible, the same reference numbers are used in the drawings and the description to refer to the same or like parts.

Figure 2:
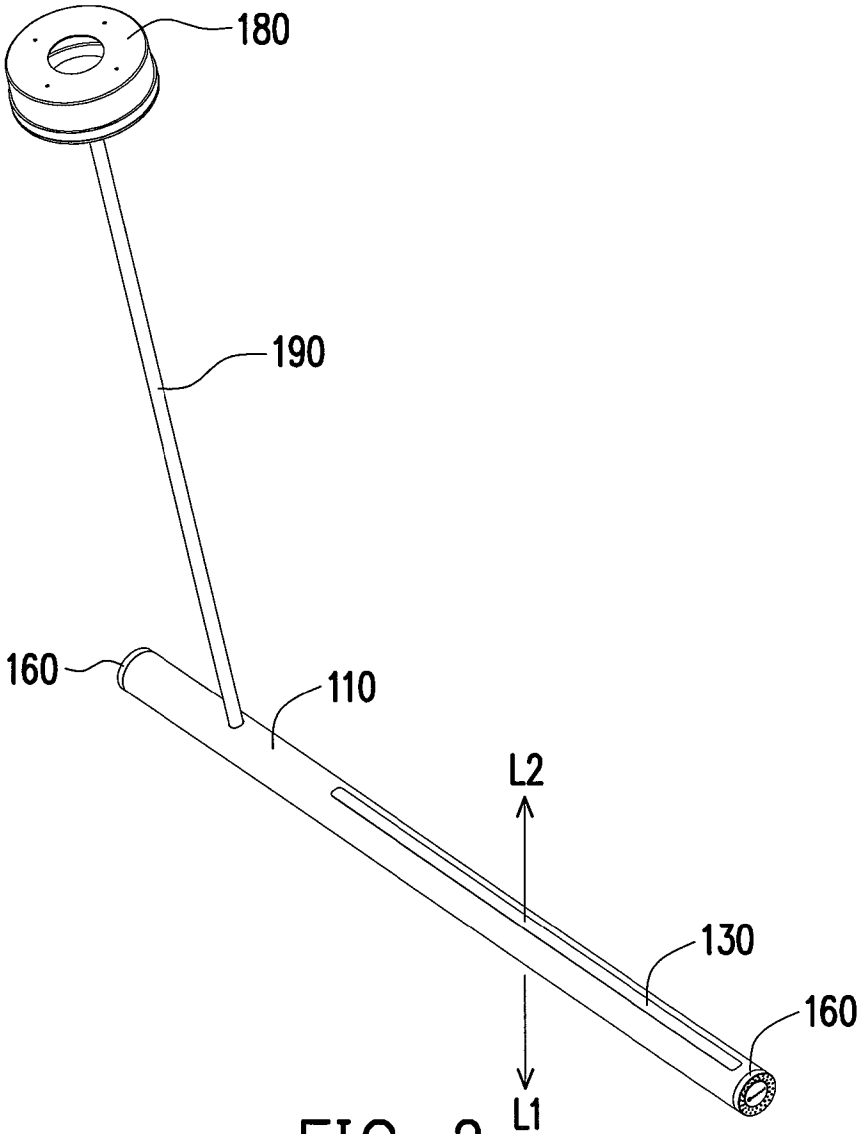
FIG. 2 is a perspective view of the lamp in FIG. 1.

FIG. 1 is a perspective exploded view of a lamp according to an embodiment of the present invention. FIG. 2 is a perspective view of the lamp in FIG. 1. Referring to FIGS. 1 and 2, a lamp 100 of this embodiment includes a tube-shaped lamp shade 110 with a space S, a first LED light source 120, a first diffuser 130, a second LED light source 140, a second diffuser 150, and two covers 160. A spacer 170 extending along a direction of a length of the tube-shaped lamp shade 110 is disposed in the space S.

The spacer 170 has a first surface 172 and a second surface 174, and the tube-shaped lamp shade 110 has a first slot 112 and a second slot 114. The first LED light source 120 is disposed on the first surface 172. The first diffuser 130 is disposed in the first slot 112, and a first hole 132 is formed at the first diffuser 130. The second LED light source 140 is disposed on the second surface 174. The second diffuser 150 is disposed in the second slot 114. The two covers 160 are disposed at two ends 116 of the tube-shaped lamp shade 110 respectively, and each cover 160 has a second hole 162.

In this embodiment, the first LED light source 120 generates heat in operation, such that an air convection occurs between the space S and an external environment. During the air convection, an external air enters the space S through the second holes 162 on the two covers 160 and flows out to the exterior from the first hole 132 on the first diffuser 130. It should be noted that, a user may appropriately adjust an angle for disposing the lamp 100 to make the first hole 132 face upwards. In this manner, the air convection efficiency of the lamp 100 is enhanced by utilizing the hot air rising principle, and thus the heat dissipation performance of the lamp 100 is also improved.

The second LED light source 140 emits a white light to the second diffuser 150, so that the second diffuser 150 outputs a white illumination light L1. Besides illumination, the lamp 100 of this embodiment may also be used for creating a certain atmosphere. When the first LED light source 120 emits a white light to the first diffuser 130, the first diffuser 130, as a color filter, outputs a color circumstantial light L2. The first diffuser 130 and the second diffuser 150 respectively enable the illumination light L1 and the circumstantial light L2 output by the lamp 100 to become more uniform.

Of course, the outputting of a color circumstantial light in the present invention is not limited to the above manner, but may be achieved through, for example, using a color light source together with a transparent block. For example, in an alternative embodiment of the present invention, the first LED light source 120 emits a color light to the first diffuser 130, and meanwhile, the first diffuser 130, as a transparent filter, outputs a color circumstantial light L2.

Referring to FIG. 1, in this embodiment, a stopping portion 112*a* is disposed and protruded from an inner edge of the first slot 112 of the tube-shaped lamp shade 110, and supports a bottom of the first diffuser 130, so as to fix the position of the first diffuser 130. The second slot 114 extends to the two ends 116 of the tube-shaped lamp shade 110, a slide-rail 114*a* is formed on an inner edge of the second slot 114, and the second diffuser 150 is movably disposed on the slide-rail 114*a*.

Referring to FIG. 2, in this embodiment, the lamp 100 further includes a base 180 and a connecting rod 190. The connecting rod 190 is connected between the base 180 and the tube-shaped lamp shade 110, and the base 180 may be connected to a ceiling or a wall of a building. The connecting rod 190 is, for example, an extension rod, which is capable of extending or retracting to adjust a height of the tube-shaped lamp shade 110. Furthermore, referring to FIG. 1, the base 180 is a hollow shell with an opening 182 formed thereon. The connecting rod 190 penetrates the opening 182, and a stopping block 192 is disposed at an end of the connecting rod 190 in the hollow shell, so as to rest against a peripheral edge of the opening 182, such that the tube-shaped lamp shade 110 is capable of rotating through utilizing the spinning of the connecting rod 190 relative to the base 180.

Figure 3:
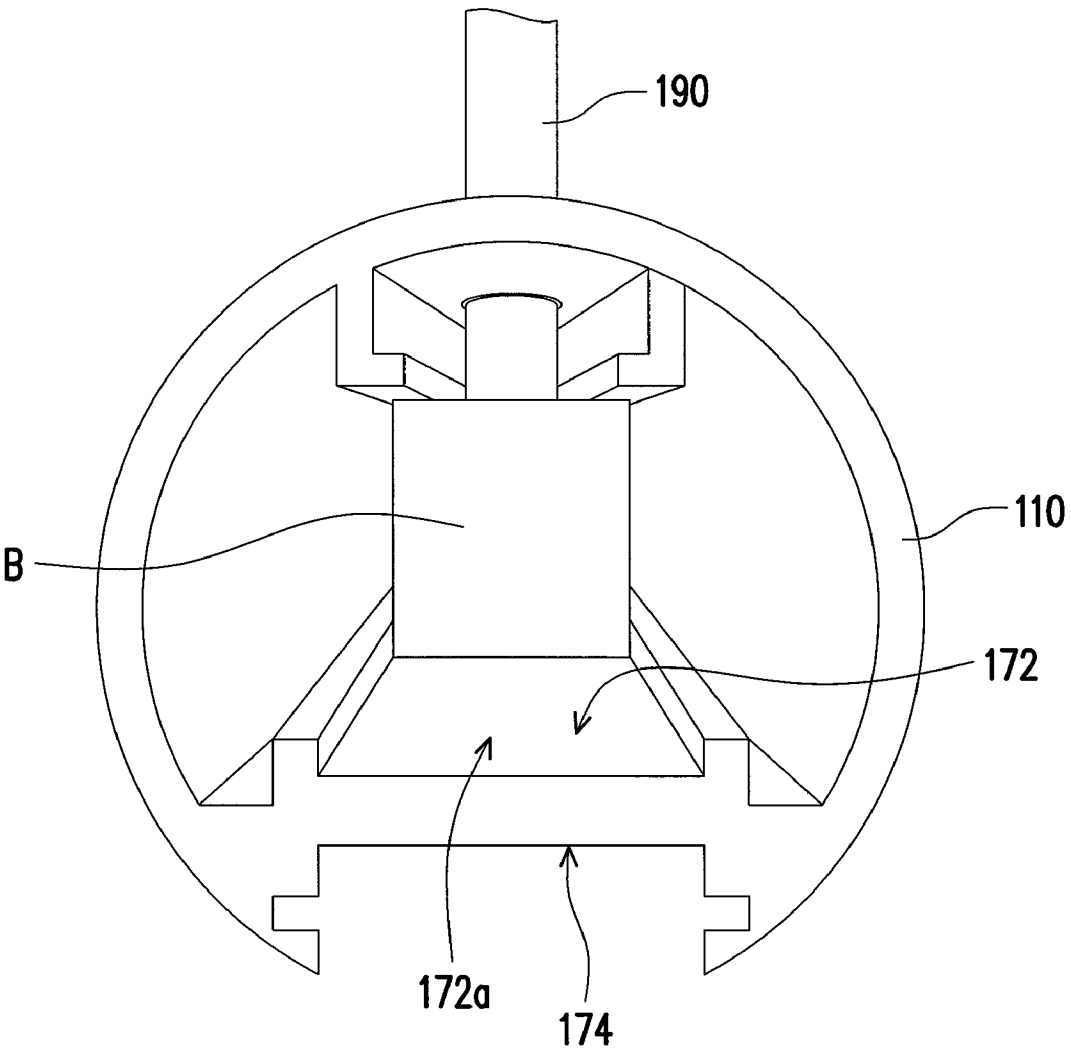
FIG. 3 is a partial side view of the lamp in FIG. 1.

FIG. 3 is a partial side view of the lamp in FIG. 1. Referring to FIGS. 1 and 3, in this embodiment, the lamp 100 further includes a weight block B disposed on the first surface 172 of the spacer 170, and the connecting rod 190 penetrates the tube-shaped lamp shade 110 and is fixed to the weight block B. The weight block B can be used for balancing the weight of the lamp 100. Furthermore, a sliding groove 172*a* is formed on the first surface 172 of the spacer 170, and the weight block B is disposed in the sliding groove 172*a*.

Referring to FIG. 1, the lamp 100 further includes a plurality of screws F penetrating the spacer 170 and the weight block B to lock the weight block B to the spacer 170, so as to make the whole structure become more stable. Moreover, the lamp 100 of this embodiment further includes two patterned elements D respectively disposed on the two covers 160. The patterned elements D are, for example, patterns or labels for decoration.

In view of the above, the lamp of the present invention has a tube-shaped lamp shade with a plurality of holes for the air to flow in and out, and thus the air convection efficiency of the lamp in operation is improved. In addition, the lamp of the present invention can respectively output an illumination light and a circumstantial light, and thus can be used for illumination and creating a special atmosphere.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A lamp, comprising:

a tube-shaped lamp shade, provided with a space and a spacer disposed in the space and extending along a direction of the length of the tube-shaped lamp shade, wherein the spacer comprises a first surface and a second surface, and the tube-shaped lamp shade comprises a first slot corresponding to the first surface and a second slot corresponding to the second surface;

a first light-emitting diode (LED) light source, disposed on the first surface;

a first diffuser, disposed in the first slot, and provided with at least one first hole;

a second LED light source, disposed on the second surface;

a second diffuser, disposed in the second slot; and two covers, disposed at both ends of the tube-shaped lamp shade respectively, wherein each cover is provided with at least one second hole.

2. The lamp according to claim 1, wherein the first LED light source generates heat in operation, such that an air convection occurs between the space with an external environment, and during the air convection, an external air enters the space through the second holes on the two covers and flows out to the exterior from the first hole on the first diffuser.

3. The lamp according to claim 1, wherein the second LED light source emits a white light to the second diffuser, so that the second diffuser outputs a white illumination light.

4. The lamp according to claim 1, wherein the first LED light source emits a white light to the first diffuser, and the first diffuser, as a color filter, outputs a color circumstantial light.

5. The lamp according to claim 1, wherein the first LED light source emits a color light to the first diffuser, and the first diffuser, as a transparent filter, outputs a color circumstantial light.

6. The lamp according to claim 1, wherein a stopping portion is disposed and protruded from an inner edge of the first slot of the tube-shaped lamp shade, and supports a bottom of the first diffuser.

7. The lamp according to claim 1, wherein the second slot of the tube-shaped lamp shade extends to the two ends of the tube-shaped lamp shade, a slide-rail is formed on an inner edge of the second slot, and the second diffuser is movably disposed on the slide-rail.

8. The lamp according to claim 1, further comprising:

a base; and a connecting rod, connected between the base and the tube-shaped lamp shade.

9. The lamp according to claim 8, further comprising a weight block, disposed on the first surface of the spacer, wherein the connecting rod penetrates the tube-shaped lamp shade and is fixed to the weight block.

10. The lamp according to claim 9, wherein a sliding groove is formed on the first surface of the spacer, and the weight block is disposed in the sliding groove.

11. The lamp according to claim 10, further comprising a plurality of screws, penetrating and locking the spacer and the weight block.

12. The lamp according to claim 8, wherein the base is a hollow shell with an opening formed thereon, the connecting rod penetrates the opening, and a stopping block is disposed at an end of the connecting rod in the hollow shell, so as to rest against a peripheral edge of the opening.

13. The lamp according to claim 1, further comprising two patterned elements respectively disposed on the two covers.

* * * * *